United States Patent [19]

Minoprio et al.

[11] 4,296,460

[45] Oct. 20, 1981

[54] LAMPS

[75] Inventors: William E. Minoprio, Blackburn; Arthur K. Horsfield, Preston, both of England

[73] Assignee: Dorman Smith Traffic Products Limited, Southport, England

[21] Appl. No.: 101,588

[22] Filed: Dec. 10, 1979

Related U.S. Application Data

[62] Division of Ser. No. 833,098, Sep. 14, 1977.

[51] Int. Cl.[3] ..... F21L 7/00

[52] U.S. Cl. ..... 362/200; 362/311; 362/360; 362/361; 362/362

[58] Field of Search ..... 362/200, 311, 360, 361, 362/362

[56] References Cited

U.S. PATENT DOCUMENTS 4,069,404 1/1978 Minoprio et al. ..... 362/200

*Primary Examiner*—Stephen J. Lechert, Jr.

*Attorney, Agent, or Firm*—Ross, Ross & Flavin

[57] ABSTRACT

A battery-powered lamp has a box-like casing with a top and side walls for housing at least one battery. At least one of the side walls has a depression which provides a generally planar depressed portion having an opening therethrough. A light source is supported in the casing. A lens, through which light from the light source can be transmitted, lens has a peripheral rim which is a friction fit in the opening. On its peripheral rim it has a plurality of ratchet-like teeth mutually spaced around the lens periphery. They make snap fits with and locate behind the material of the side wall bounding the opening so as to resist lens removal. Outside the peripheral rim of the lens is a surrounding flange which limits the depth of insertion of the lens in its opening. The side wall bounding the opening has a plurality of spaced notches which register with the lens teeth to prevent rotation of the lens relative to the opening. The lens teeth are triangular in configuration and are integral with the lens rim. Two opposite side walls each has a depression in which an opening is disposed. The lens is a friction fit in each of the openings.

8 Claims, 6 Drawing Figures

LAMPS

This is a division of our copending application Ser. No. 833,098 filed Sept. 14, 1977.

This invention relates to a battery-powered lens and includes a casing housing one or more high-capacity batteries and a lens structure mounted on the casing. The casing may be mounted on such as a tripod, barrier, bracket or the like. Such lamps are used, for example, as road hazard warning lamps, for airfield illumination and like purposes.

Often, such lamps have used casings made of moulded plastics. More recently, the costs of plastics materials has increased substantially and it became desirable therefore, for economies to be achieved if at all possible to avoid excessive increases in manufacturing costs and, consequently, in selling prices.

The casings of such lamps have generally comprised a hollow body part which accommodates the battery or batteries, as well as a removable base part or closure held in position by a bolt and which, when in position, serves to retain the battery or batteries.

The present invention is based upon the appreciation that a considerable saving of costs can be achieved if the lamp is designed so as to eliminate the need for a base part or closure for the body part. The cost of one component can thus be obviated. By simplification of the configuration of the body part, it can be made of metal which is relatively less expensive at the present time.

The invention provides, as a first feature, a battery-powered lamp of the kind having a casing comprising a box-like body part which houses one or more batteries and which may be mounted on a support such as a tripod. The casing is shaped to have an opening for insertion of the battery or batteries therein, and has one or more ledges, shoulders or other retaining protuberances for the battery or batteries to engage therewith and thus to be retained within the casing.

With such arrangement, of course, it is not necessary to provide a separate base part or closure, since retention of the battery or batteries is achieved by the combination of the retaining protuberances and a bolt.

In the event the casing is made of a plastic, the ledges, shoulders or other retaining protuberances may be moulded integrally.

The casing may, however, conveniently be made of sheet metal, in which case the retaining protuberances may be provided by one or more lips or tongues formed by pressing out or bending over one or more parts of the casing or by one or more pegs secured to or through the casing walls or by respective angle members secured to the respective inner casing walls.

The lamp may be designed to be powered by and for its casing to accommodate a single battery or a plurality thereof.

The casing will accommodate a light source and will have one or more lenses set in its wall or walls for transmission of light. Each such lens will be preferably of a rigid plastics material, having a peripheral rim by which it may be friction fit in a respective complementary opening in the respective casing wall.

For fitting each lens in place, it is only necessary to press the lens into its respective opening, the steps of securing the lens into a surrounding frame and the frame into a casing wall being avoided.

Preferably, each opening is formed with an inwardly-directed peripheral rim with which the lens rim engages frictionally.

Each lens preferably has a surrounding flange or lip outside its rim to define the possible depth of insertion of the lens into its opening.

To ensure that each lens cannot fall out of its opening or become dislodged therefrom, each lens preferably has on its peripheral rim, a plurality of ratchet-like teeth which, upon insertion of the lens into its respective opening, locate behind the material of the respective casing wall to resist removal of the lens from its opening.

The teeth are preferably of triangular configuration and are formed integrally with the lens rim. The triangular configuration ensures that the teeth locate behind the material of the respective wall of the lamp so as to resist removal of the lens from its opening.

Each lens is preferably circular, but other configurations, such as hexagonal, octagonal or square are possible.

The lamp incorporates an electrical switch assembly comprising a support carrying a conducting protuberance and a slidable conductive strip member mounted for longitudinal sliding movement relative to the support and having a bridge portion disposed to register with and form a bridge over the protuberance to provide an "off" condition of the switch, in which there is no contact between the slidable strip member and the protuberance. Longitudinal movement of the slidable strip member serves to bring the slidable strip member, adjacent to the bridge portion thereof, into contact with the protuberance to provide an "on" condition of the switch.

The bridge portion may be formed in the slidable strip member by a recess or niche being cut out of the strip member.

In one advantageous embodiment, however, the bridge portion may be constituted by an arched or joggled portion formed by bending the strip member.

The support may be provided by a carrier member which serves the practical function of carrying a number of components (of which the switch constitutes one) of the lamp. The carrier member may carry a bulb holder, and if desired, appropriate flashing circuitry connected with the bulb holder.

The slidable strip member may constitute one of two conductive terminal strips, which may be carried by the carrier member, so as to be engageable by corresponding terminals of the battery or batteries.

The casing has restricted openings, at opposed locations, permitting access to the respective ends of the slidable strip member, e.g. by means of a thin rod, prong or like element, for displacing the strip member by pressure applied to the one or the other of the ends.

The ends of the slidable strip member may be bent so as to extend approximately perpendicular to the plane of the strip member.

In summation, the invention may be described as comprising, in a battery-powered lamp, a box-like casing with a top and side walls for housing at least one battery. At least one of the side walls will have a depression to define a generally planar depressed portion having an opening therethrough. A light source will be supported in the casing. A lens, through which light from the light source can be transmitted, will have a peripheral rim which is a friction fit in the opening. On its peripheral rim, it will have a plurality of ratchet-like teeth mutually spaced around the lens periphery. The teeth will make snap fits with and locate behind the material of the side wall bounding the opening so as to resist any lens removal. Outside the lens peripheral rim will be a surrounding flange which limits the depth of insertion of the lens into its opening. The side wall bounding the opening will have a plurality of spaced notches which will register with the lens teeth to prevent rotation of the lens relative to the opening. The lens teeth will be triangular in configuration and will be integral with the lens rim. Two opposite side walls will each have a depression in which an opening will be disposed. The lens will be a friction fit in its opening.

Figure 1:
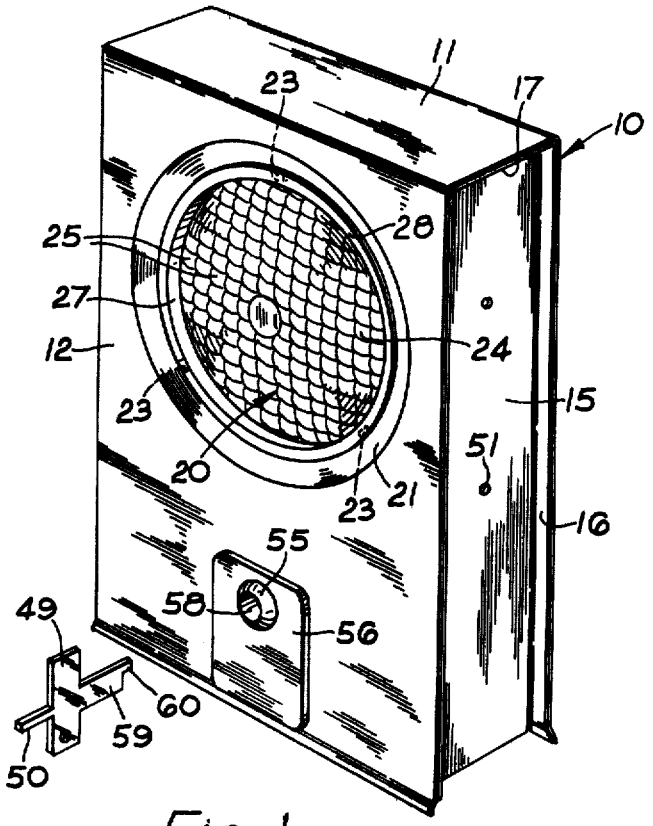
FIG. 1 is a perspective view illustrating a preferred embodiment of lamp.
Figure 2:
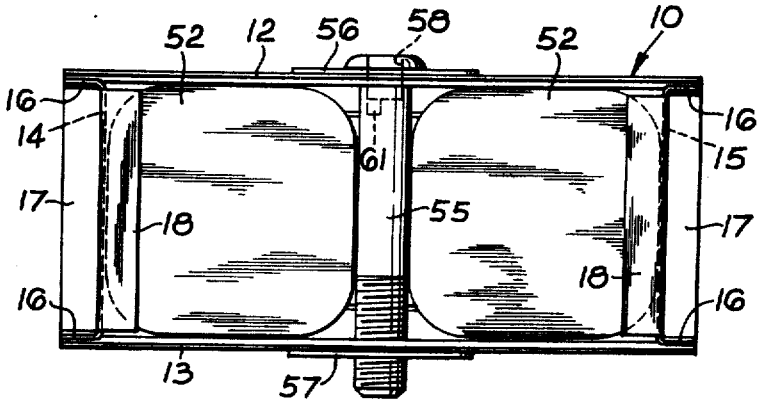
FIG. 2 is an underneath plan, to an enlarged scale, of the FIG. 1 lamp.

The lamp is a road hazard warning lamp and comprises a generally rectangular box-like open-bottomed casing 10 made of sheet metal and defining a top wall 11 connected at opposite edges respectively to a front wall 12 and a rear wall 13, walls 11, 12, 13 being integral with one another and being formed by appropriately bending a flat element of sheet metal. Rectangular side gussets or walls 14 and 15 having side flanges 16 and top flanges 17 are located between front and rear walls 12 and 13, being secured in place by welding or brazing flanges 16, 17 to top, front and rear walls 11, 12, 13 as appropriate. Side gussets 14, 15 constitute inset side wall members of casing 10.

Along their bottom edges, at the open bottom of the casing, side gussets 14, 15 have respective inturned lips or tongues 13 which define respective ledges or protuberances on the inner surface of the side gussets or walls.

Figure 5:
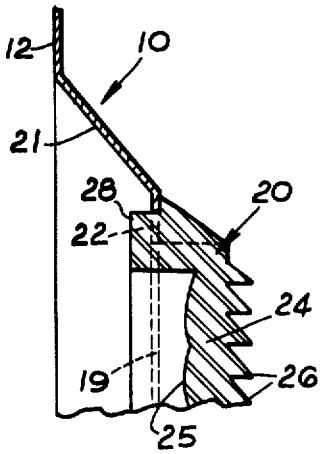
FIG. 5 is an enlarged fragmentary sectional detail illustrating how the lenses of the lamp of FIGS. 1 to 4 are retained in place.

Toward the top of the casing, front and rear walls 12, 13 are each formed with a respective opening 19 into which a respective circular lens 20 is located. Each opening 19 is formed in a respective inwardly-pressed surrounding portion 21 of front and rear walls 12, 13 respectively, portions 21 circumscribing respective circumferential rims 22. Each such rim 22 has three equiangularly-spaced radial notches 23 therein. Each lens 20 comprises a central light-transmitting portion 24, formed at one side with cushions 25 and at the other side with concentric tooth-like ridges 26, with grooves therebetween. See FIG. 5.

Central portion 24 is surrounded by an approximately cylindrical rim 27 and formed with a flange or lip 28 determines the depth of insertion of each lens 20 into its opening 19. Three equispaced pawl-like teeth 29 are provided on cylindrical rim 27 and these correspond with the respective notches 23 so that, upon each lens 20 being pressed firmly into its opening 19, teeth 29 snap behind circumferential rim 22 of the respective wall 12 or 13 to ensure that lens 20 cannot unintentionally be removed from the front or rear wall.

In the fitting, each lens 20 is simply pressed into its respective opening 19, rim 27 being a tight friction fit in rim 22 around the respective opening 19. As lens 20 is pressed in, teeth 29 on rim 27 eventually snap behind the material of the respective panel of the lamp, flange or lip 28 limiting the depth by which lens 20 can be pressed in, but abutting the outer surface of the respective front or rear wall 12, 13. The engagement of the teeth with the material of the panel prevent the lens from becoming disengaged from its opening, since such teeth engage firmly with the inner surface of the material of the panel around the respective opening in the event the lens tends to move outwardly.

Figure 6:
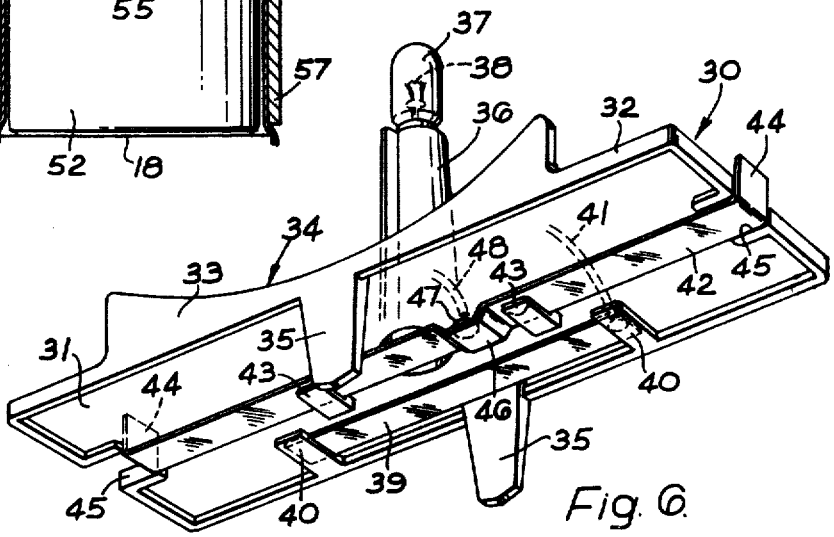
FIG. 6 is an underneath perspective view illustrating a carrier member forming part of the lamp of FIGS. 1 to 5.

As in FIG. 6, a carrier member 30 is accommodated in casing 10 immediately below the lowermost parts of lenses 20 and comprises a plate-like or board-like element 31 stiffened by a thickening 32 around its outer edge and dimensioned so as to fit with a clearance, within casing 10, substantially parallel to top wall 11.

Along the two opposite lower sides of element 31 are two integral locating projections 33 which present respective arcuate locating edges 34 to lenses 20. The curvatures of edges 34 is complementary to the outer curvatures of rims 27 so that carrier member 30 can be located relative to lenses 20 by locating edges 34 engaging with the respective rims 27.

Two battery-spacing fingers 35 are formed integrally with element 31 so as to project therefrom at the side remote from locating projections 32, substantially midway along the longitudinal edges of element 31.

Projecting substantially centrally from element 31, between locating projections 32 is a post-like bulb holder 36 into which fits a low-voltage bulb 37. The height of holder 36 is such that when carrier 30 is in position with locating projections 33 positioned relative to the lenses, filament 38 of bulb 37 is in accurate register with the optical axes of lenses 20, and optimum transmission by lenses 20 of light from bulb 37 is attained. Since locating edges 34, whereby carrier member 30 is located relative to lenses 20, are arcuate and complementary to the outer curved surfaces of the lenses, filament 38 is properly located at the optical axes of lenses 20 even if carrier member 30 is not absolutely parallel to top wall 11.

On its underside, element 31 carries, adjacent one longitudinal edge, a fixed terminal strip 39 which is held in place by retainers 40 integrally-moulded with member 31. A lead 41 connects at one end to terminal strip 39 and at its other end to an appropriate pole of holder 36.

Additionally, extending substantially along the longitudinal center line of member 31 is a movable terminal strip 42 which serves also as a switch for the lamp. Strip 42 is held to the underside of member 31, while being slidable relative to the latter, by two L-shaped retainers 43. It has, at its two ends, upwardly-bent tabs 44 which locate in or register with notches 45 provided in each end of member 31. Tabs 44 serve to determine the extent by which terminal strip 42 can be displaced.

Figure 3:
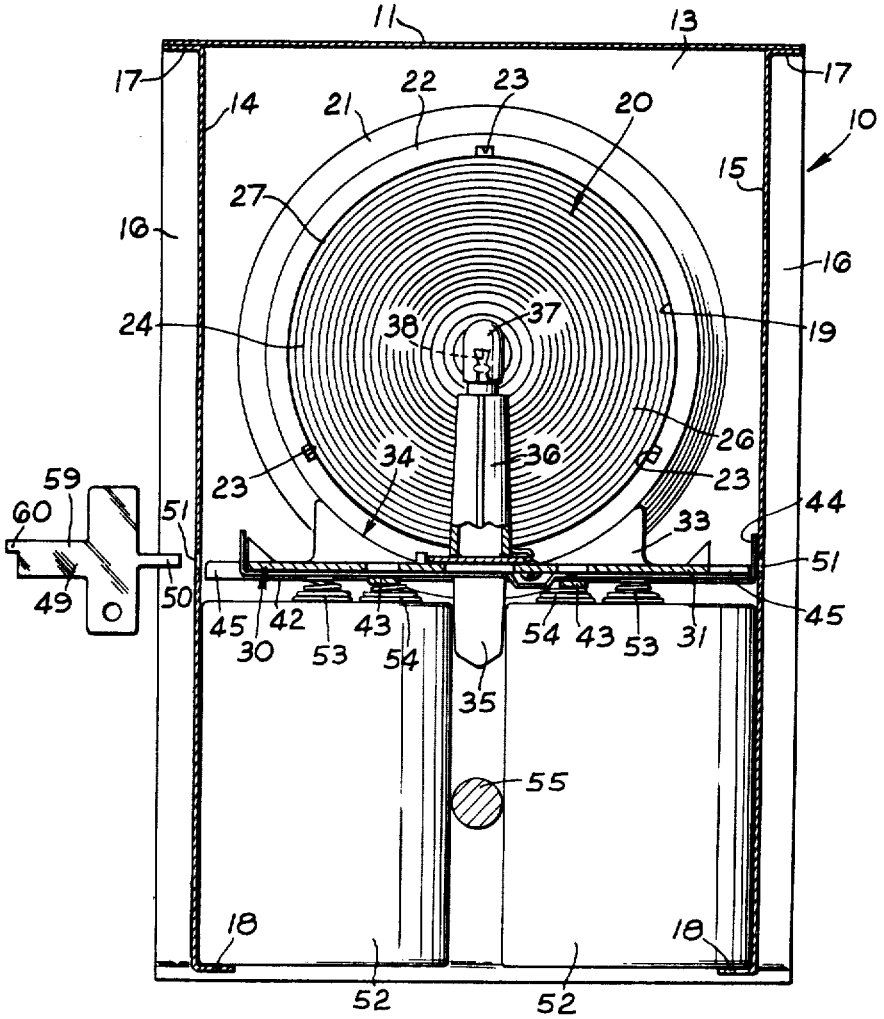
FIG. 3 is a sectional front elevation of the lamp of FIGS. 1 and 2, to the same scale as FIG. 2.
Figure 4:
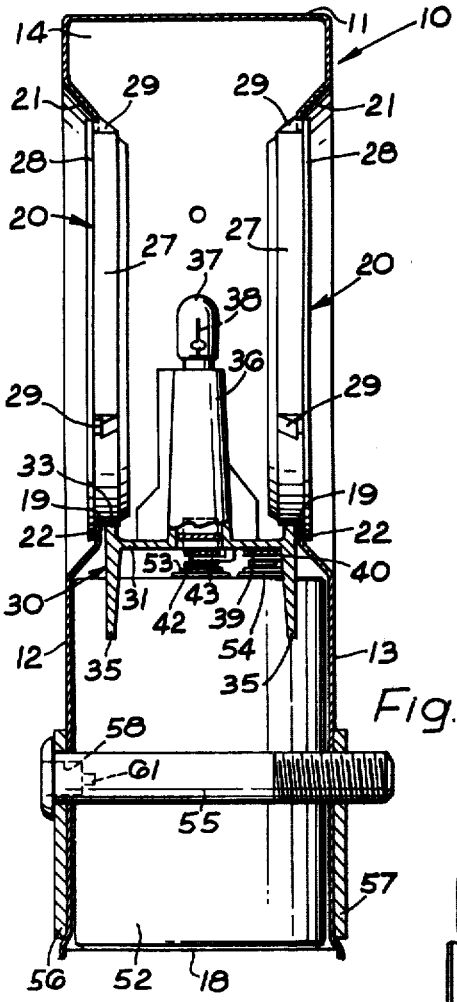
FIG. 4 is a sectional side elevation of the lamp of FIGS. 1, 2 and 3.

Terminal strip 42 has a bridge portion 46 formed therein by appropriate bending. This is shown, in both FIGS. 3 and 6, in an off position in which it bridges a contact 47 in the form, for example, of a blob of solder. Contact 47 is connected, by way of a respective lead 48 (if desired with the interposition of appropriate circuitry to ensure flashing of bulb 37) to the other pole of holder 36. In the event of strip 42 being displaced longitudinally (e.g. by means of a tool 49 having a narrow prong 50 (see FIGS. 1 and 3) inserted through the appropriate one of two holes 51 to engage with one of two tabs 44, bridge portion 46 can be brought out of register with contact 47 which then contacts with strip 42 which is then in its "on" position.

Carrier member 30 divines, in the lower part of casing 10, a battery compartment which is occupied by two batteries 52, each having two spiral resilient wire terminals 53 and 54, of which terminal 53 is centrally disposed in the top of each battery 52 and therefore engages with movable terminal strip 42, while terminal 54 is disposed towards one corner of the top of the respective battery and engages with terminal strip 39.

Batteries 52 are, therefore, connected in parallel with bulb 37 in holder 38 and current to bulb 37 can be switched on or off by appropriate movement of strip 42.

At their upper ends, batteries 52 locate one to each side of fingers 35 of the underside of carrier member 30. It will be appreciated from FIG. 3 that, upon insertion of batteries 52 (which is effected one at a time with bolt 55 removed), each battery has to be engaged, by its bottom edge, with a respective one of the two lips or tongues 18, by appropriate lateral movements of the bottom parts of the batteries. When in located position with lips or tongues 18, the batteries serve to retain carrier member 30 in place by terminals 53, 54 thereof loading carrier member 30 resiliently towards lenses 20 so as to locate with the latter by locating projections 33.

Bolt 55 extends through a hole in front wall 12, and a registering hole in a reinforcing plate 56 secured to front wall 12, and threadedly engages into a corresponding hole in rear wall 13 and a similar reinforcing plate 57 secured to rear wall 13. Rotation of bolt 55 for inserting it in place or removing it can be effected by the insertion, into a recess 58 in its head, of tongue 59 of tool 50, which tongue has an offset tooth 60 which engages into an eccentric depression 61 at the bottom of recess 58. Bolt 55 can, if desired, be used for securing the lamp to a support, such as an upright post, barricade, tripod or the like.

Once batteries 52 have been inserted in their positions, and bolt 55 has been screwed in place, removal of the batteries is not possible. Bolt 55 keeps the batteries in engagement with lips or tongues 18 and they cannot be disengaged from the lips or tongues for removal from the casing until bolt 55 is removed. In turn, this cannot be effected by anyone not in possession of appropriate tool 49.

The preferred embodiment of the lamp is composed of a minimum of components and accordingly is relatively inexpensive to manufacture. Assembly of the components is easy, in that carrier member 30 simply has to be inserted into casing 10 the right way up and then pressed into its correct position by subsequent fitting of the batteries which remain in place simply by resting on the lips or tongues 18 while bolt 55 is being inserted and tightened.

Terminal strip 42 has to be present, of course, for engagement therewith of the respective terminals of the batteries, and by making strip 42 displaceable so as to cooperate with contact 47, the need for the provision of a separate switch arrangement is avoided and a consequential cost saving is obviously achieved.

The invention is not confined, of course, to the foregoing example, and variations may be made thereto. For instance, the ledge or protuberance arrangement which serves, in conjunction with bolt 55, for retaining batteries 52 in position may be executed in various ways differing from what has been illustrated. Thus, instead of the ledges or protuberances being provided by bentover lips or tongues 18, they could be provided by separate angle members, secured to the inner surfaces of the side walls of the casing, e.g. by welding or brazing, or by pegs or tongues which are secured into the project through the sidewalls of the casing. The casing could, of course, be formed by moulding from a suitable plastics material in which event the ledges or like protuberances can be moulded integrally or can be incorporated by way of moulded-in steps or shoulders. It is not essential that the casing should both accommodate the lenses and the batteries, and the casing could, if desired, be in two parts, connected together of which one part is provided by or is fitted with the lenses and the other part accommodates the batteries.

Insofar as the switch arrangement, provided by the displaceable terminal strip 42, is concerned, it will readily be understood that alternative means, differing from what has been described, may be provided for displacing the strip 42, and, therefore, switching on and off, for instance involving a pivotable dolly or rotatable knob.

The mode of operation of the switch assembly comprising slidable strip member 42 and the conducting protuberance or contact 47 bridged by the bridge portion 46 of the slidable strip member 42 will readily be understood from the foregoing description. While the bridge portion 46 of slidable strip 42 actually bridges the protuberance 47, the switch assembly is in an "off" or open condition and no current passes to the bulb in the bulb holder. When the lamp is required to be switched on, the user inserts tool 49 by its prong 50 into an appropriate one of the two openings 51 in the side walls of the casing, thereby to engage the corresponding end 44 of strip member 42 and to slide the latter relative to the carrier (and the resilient contacts of the battery) until it contacts the protuberance. This gives an "on" or closed condition of the switch assembly, at which current is provided to the bulb by way of the flasher circuit.

For switching off, prong 50 is inserted into the other of the openings to engage the other end of the slidable strip and displace the latter back to its "off" position.

It will be appreciated that the switch assembly is obtained in an extremely simple and inexpensive manner. It would be necessary to provide the two terminal strips for engagement by the battery contacts in any event, and the switch assembly is obtained by the simple expedient of making one of these strips movable, and engageable with and disengageable from, the conductive protuberance.

It will readily be understood also that the invention can be applied to any construction of lamp involving one or more lenses set into a generally flat panel of a casing of the lamp and that such lamp need not be battery-powered but could, for example, be a paraffin lamp.

Of course, the lenses do not have to be circular; they can be of any practical shape, for example, square, hexagonal or octagonal.

We claim:

1. A battery-powered lamp comprising a casing in the form of a box-like body part having a top and front and rear and side walls for housing at least one battery, at least the front wall having a depression which provides a generally planar depressed portion in which an opening is disposed; a light source supported in the casing; and a lens through which light from the light source can be transmitted, which lens has a peripheral rim which is a friction fit in said opening and has, on the peripheral rim, a plurality of ratchet-like teeth which are mutually spaced around the periphery of the lens and which make snap fits with and locate behind the material of the front wall bounding the opening to resist removal of the lens from its opening.

2. A battery-powered lamp as claimed in claim 1, wherein the lens has outside its peripheral rim a surrounding flange which limits the depth of insertion of the lens in its opening.

3. A battery-powered lamp as claimed in claim 1, wherein the lens is circular.

4. A battery-powered lamp as claimed in claim 3, wherein the material of the front wall bounding the opening has a plurality of notches which are mutually spaced around the periphery of the opening and which register with the teeth on the lens to prevent rotational movement of the lens in the opening.

5. A battery-powered lamp as claimed in claim 1, wherein the teeth of the lens are triangular in configuration and are integral with the rim of the lens.

6. A battery-powered lamp as claimed in claim 1, wherein the lens has three teeth.

7. A battery-powered lamp as claimed in claim 1, wherein by the rear of the body part also has a depression which provides a generally planar depressed portion in which an opening is disposed and wherein a lens is a friction fit in said opening.

8. A battery-powered lamp as claimed in claim 1, wherein the lens is of rigid plastics material.

* * * * *